United States Patent [19]

Fortin

[11] 4,023,323

[45] May 17, 1977

[54] CONSTRUCTION ELEMENT

[76] Inventor: Jean Marie Fortin, 1996 St. Henri Blvd., Mascouche, Quebec, Canada

[22] Filed: Dec. 30, 1975

[21] Appl. No.: 645,446

[30] Foreign Application Priority Data

Nov. 21, 1975 Canada ..... 240187

[52] U.S. Cl. ..... 52/712; 52/406; 52/404

[51] Int. Cl.[2] ..... E04C 5/00; E04B 2/00

[58] Field of Search ..... 52/712, 7, 508, 408, 52/404, 406; 214/10

[56] References Cited

UNITED STATES PATENTS

| | | | |
|---|---|---|---|
| 2,239,394 | 4/1941 | MacKechnie | 52/508 |
| 2,278,732 | 4/1942 | Parsons | 52/404 |
| 3,231,944 | 2/1966 | Bennett | 52/406 |
| 3,466,825 | 9/1969 | Guddal | 52/408 |

*Primary Examiner*—Ernest R. Purser
*Assistant Examiner*—Robert C. Farber

[57] ABSTRACT

A construction element adapted particularly for use in the securement of insulation batts or boards between framing or studding members is disclosed. The element has a generally U-shape and comprises an elongate central body section of a length to be received between two adjacent stud members of standard spacing without deformation. The ends of the body section are angled with respect to the body section providing lateral arms of a length less than the depth of the stud members, and pointed flanges extend from the lateral arms for driving penetration into the studs.

5 Claims, 9 Drawing Figures

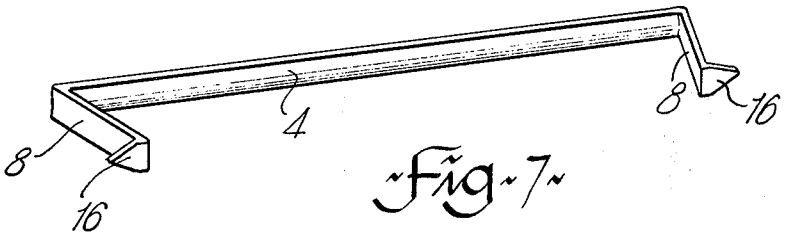
Fig. 7
Fig. 8
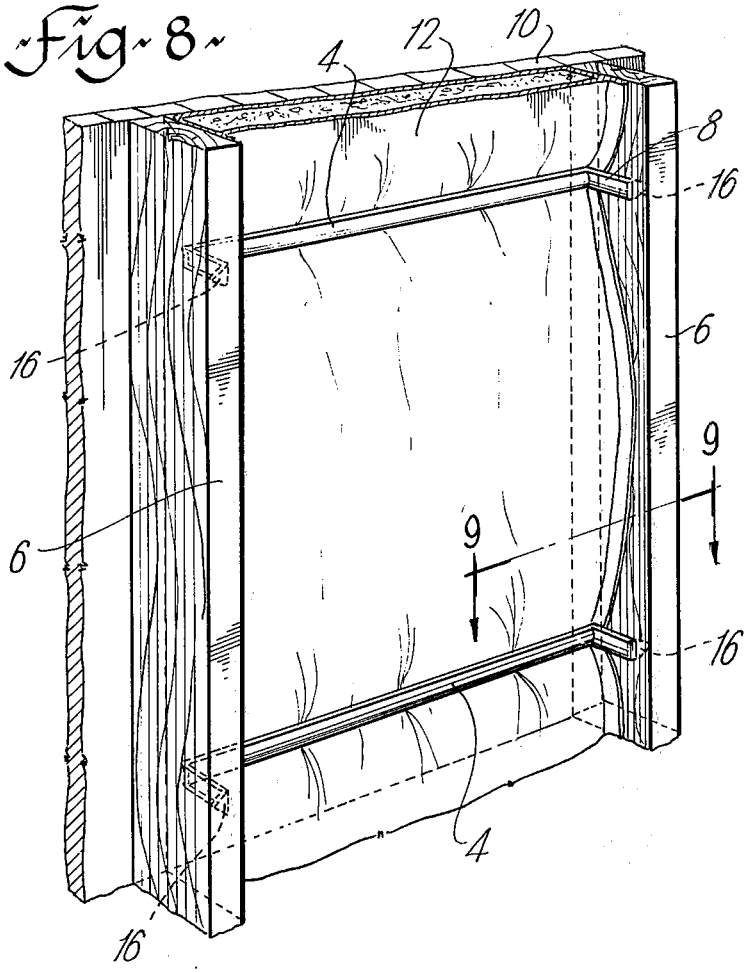
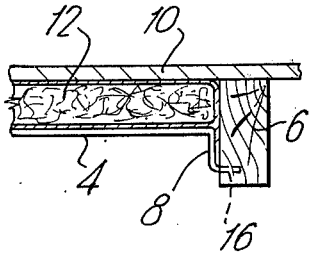
Fig. 9

CONSTRUCTION ELEMENT

The present invention relates to a construction element or staple particularly adapted for the securement of insulation boards or insulation batting between framing or studding members.

Most insulation material in use to-day is batting containing fibreglass insulation material or the like, which is provided with outstanding side edges or lips to be used for securement of the bats between framing or studding members of standard widths. In some cases, the batts are secured between the studs by hand-operated staplers or alternatively is simply tacked at various positions with finalization of securement of the batts being accomplished during installation of the interior sheeting of the wall. Stapling and nailing are time-consuming and in view of high labour costs, the time required to position and secure insulation in position results in increased cost in construction and consequently in increased cost to the eventual purchaser.

It is the main purpose of the present invention to provide for simple and speedy securement of insulation material between framing or studding members. No additional materials such as staples or nails are required, and the worker when installing insulation simply holds the present construction elements in position between the studding and against the insulation material and with one or two quick raps with his hammer secures the element in position in an economical and speedy manner not possible before.

Various attempts to achieve the present objectives have been made in the past but to the best of applicant's knowledge, none have been particularly successful and none have apparently achieved any measure of commercial success.

U.S. Pat. No. 2,239,394 issued Apr. 22, 1941 to Harry W. MacKechnie, and assigned to Johns-Manville Corporation, relates to devices for assisting in the positioning and securement of insulation material between spaced studding members. In this patent, a wire network having laterally extending prongs which are of a length greater than the distance between the studding members is employed, and when the insulation material is in position, the wire network is simply pushed centrally inwardly between the studding thus forcing the outer prongs to engage between studding and hold the insulation in position. One disadvantage of the proposal of U.S. Pat. No. 2,239,394 is that an on-site workman must cut and otherwise prepare the wire network to fit a particular location and this preparatory work, of course, results in delays in finishing the job. A further disadvantage of the network support shown in this U.S. Patent is that it supposes that the carpenters erecting the initial studding are conscientious in their duties and have positioned the studding at precise centres. If the studs are not precisely centered, and the distance between them overly great, the workmen installing the insulation cannot use the network support at all. If the studs are too close to one another the workmen must shorten the laterally protruding prongs for proper positioning of the network between the studs.

The present invention which provides single staple elements requires no on-site modification to the elements at all, and the element is of such configuration that it can be successfully and quickly used even though substantial error may be present in the positioning of the studding. Using the present element, and if the distance between studding is substantially shorter than standard, the workman can simply position the element at an angle between the studs and hammer it home; and in the case where the centers of the studs are greater than standard, the dimensions and configuration of the present element enable it to be successfully used, even though the error in stud placement may be substantial.

U.S. Pat. No. 3,231,944 issued Feb. 1, 1966, to E. J. Bennett, and U.S. Pat. No. 2,278,732 issued Apr. 7, 1942, to J. R. Parsons, both relate to "between" studding supports for batting or other insulation material. Both of these U.S. Patents require that the studding be quite precisely positioned for satisfactory use and if this is not the case then other means for securing the batting in position must be found.

As represented by the above U.S. Patents, various efforts have been made to solve the problem of simple and economical insulation installation. To a degree, all past proposals have been satisfactory, but as all resort to securement as a result of an arching and wedging action, none provide the positive degree of element and insulation positioning and securement that is accomplished as a result of the present invention.

Specifically, the present invention relates to a construction element adapted particularly for use in the securement of insulation batts or boards between framing or studding members. The element has a generally U-shape, and comprises an elongate central body section of a length to be received between two adjacent stud members of standard spacing without deformation. The ends of the body section are angled with respect to the body section providing lateral arms of a length less than the depth of the stud members. Pointed flanges extend from the lateral arms for driving penetration into the studs.

In one embodiment, the pointed flanges extend outwardly from the lateral arms in opposed directions substantially parallel with the longitudinal axis of the body section.

In a further embodiment, the ends of the lateral arms extend outwardly and forwardly in reversed U-shape configuration, terminating in said pointed flanges, and whereby the length of the lateral arms determine positioning of the body section with respect to studding depth.

The object of the present invention is to provide an element or staple particularly for use in the securement of insulation batts or boards between framing or studding members and which through use will shorten the time required for insulation installation.

A further object is to provide a single piece construction element for the securement of insulation material between framing members and which consists of an elongate central body section of a length to be received between two adjacent stud members of standard spacing without deformation, and wherein the ends of the body section are angled with respect to the body section providing lateral arms of a length less than the depth of the studding members, and wherein the lateral arms carry pointed flanges for driving penetration into the studs.

As will be discussed in more detail below, a further feature of the present invention is to provide additional wall rigidity as a result of use and to avoid or minimize later warping of "green" wood studding lumber in a manner not before contemplated or possible by any of the prior art devices.

The present invention will now be more specifically described with reference to the accompanying drawings, wherein:

FIG. 7 illustrates a still further embodiment of the invention in perspective view;

FIG. 8 shows the embodiment of FIG. 7, in position with respect to studding and insulation material; and FIG. 9 is a sectional view taken along line 9—9 of FIG. 8.

The attached drawings will now be described in detail with like numerals indicating like parts.

Figure 2:
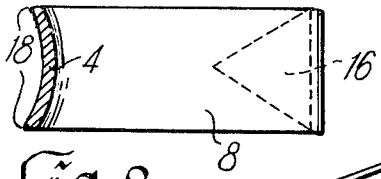
FIG. 2 is a sectional view taken along line 2—2 of FIG. 1.

The construction element or staple shown generally by numeral 2 consists of a central elongate body section 4 which is of a length to be received between two adjacent stud members 6 of standard spacing without deformation. In the construction industry, it is usual when erecting vertical studding to place the studs 6 at 16 inch centres, and if the element or staple of the present invention is to be utilized to hold insulation batting or insulation boards between such standard spacing studding, the length of the central body section 2 will be approximately just a fraction over 14 inches long to be easily received between the studding members.

Figure 1:
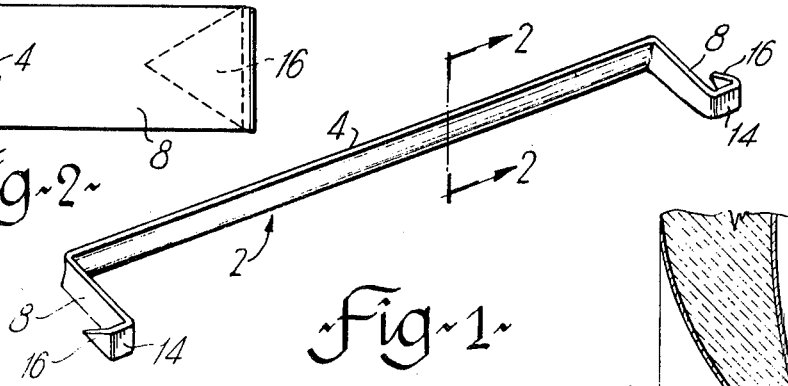
FIG. 1 illustrates one embodiment of the construction element or staple according to the present invention in perspective view.
Figure 4:
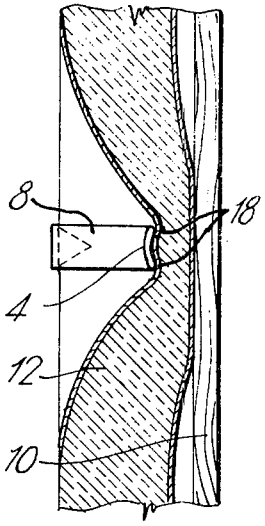
FIG. 4 is a sectional view taken along line 4—4 of FIG. 3.
Figure 5:
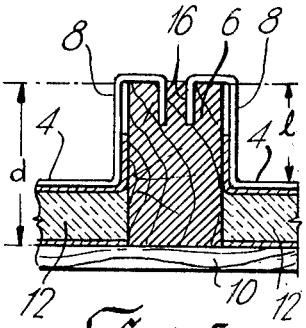
FIG. 5 is a sectional view taken along ling 5—5 of FIG. 3.

As will be appreciated from FIG. 1, the element or staple is of generally U-shape configuration with each end being normally angled (angled at 90° or substantially 90°) to provide lateral arms 8 of a length governing position of the body section with respect to studding depth. It is usual that so-called 2 inches × 4 inches studs (which is in reality 1¾ inches by 3¾ inches, or more recently of less dimensions) is used in building construction and the length *l* (see FIG. 5) of the lateral arms 8 will be chosen to be somewhat less than the depth *d* (see FIG. 5) of the studding and may be dependent upon the thickness of the specific insulation material to be used so that once the construction element is secured in position, the insulation material will be firmly held in position against the outer sheeting 10 of the structure as clearly shown in FIGS. 3, 4 and 5. FIGS. 4 and 5 illustrates that the lateral arms 8 have a length less than the depth of the stud 6 whereby an insulation batt 12 positioned between the studs is held snugly against the outer sheeting 10 by the construction element. Of course, the length of the lateral arms 8 will primarily be dependent upon the thickness of the insulation batts to be used, and also whether the insulation is to be in the form of batts or board material such as Styrofoam (registered trade mark) as will be appreciated.

The ends of the lateral arms 8 extend outwardly as longitudinal arm sections 14, and then forwardly in reverse U-configuration (reversed in respect of the overall U-configuration of the element) and terminate in pointed flanges 16 for driving penetration into the studs.

Figure 3:
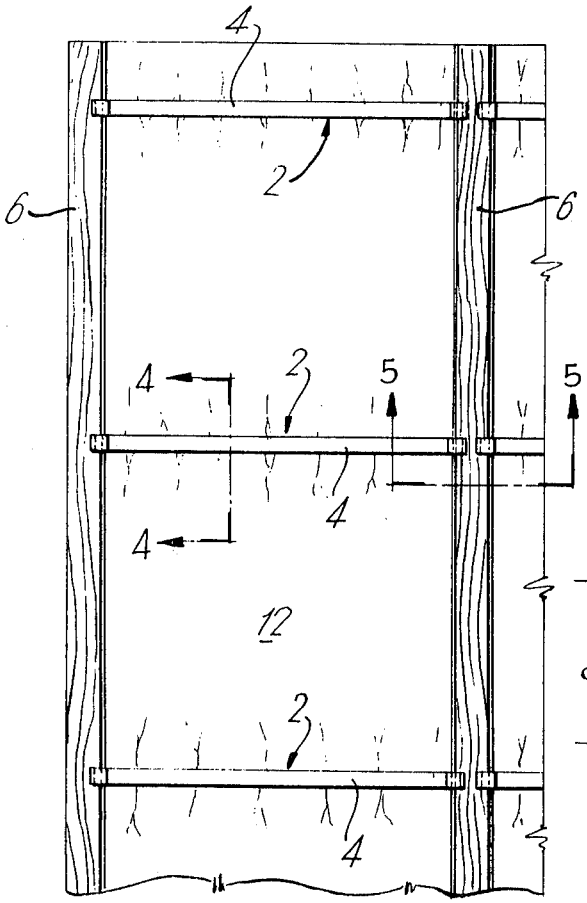
FIG. 3 is a side view of framing or studding members showing use of the present invention to hold insulation batts in position.

In use, an insulation batt 12 as shown in FIG. 3 is positioned between studs 6 and construction elements 2, according to the present invention are simply positioned between the studs as shown and hammered or driven so that the pointed flanges 16 penetratingly engage into the outer surface of the studs; the driving of the construction element into position will securely hold insulation material into position as clearly shown in FIGS. 4 and 5.

FIG. 5 is a sectional view taken along line 5—5 of FIG. 3, and shows the ends of two adjacent construction elements after their pointed flanges 16 have been driven into the studs 6. The holding of the insulation material between the sheeting 10 and the construction elements 2 will also be fully appreciated from the showing in FIG. 4.

In a preferred construction, the central body section 4 is of curved sectional configuration as shown in FIG. 2 and the curvature possessed by the body section 2 in addition to providing longitudinal strength in body member 4 also provides friction edges 18 for more securely holding the insulation material in position.

Figure 6:
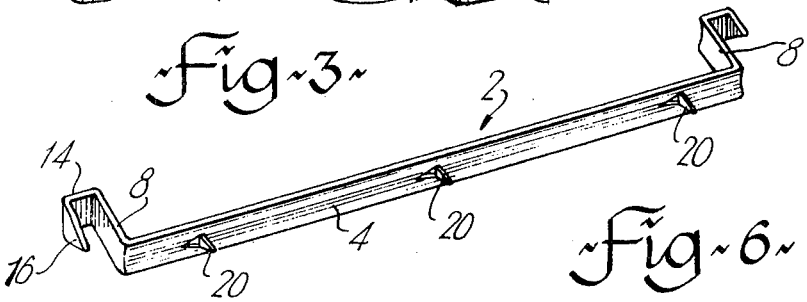
FIG. 6 shows a further embodiment of the invention basically illustrated in FIG. 1.

A further embodiment of the present invention is shown in FIG. 6. In this embodiment the body section 4 is provided with sharpened prong members 20 for engaging into the insulation material to more securely hold it in position. It is appreciated that much of the roll insulation presently available is provided with a moisture barrier on the inside surface thereof and it is not practical to use the embodiment shown in FIG. 6 with such insulation material. However, in cases of roll insulation batting where no such vapour barrier is provided, or when a separate vapour barrier is to be installed, or even when solid insulation boards are to be used in place of roll batting, the embodiment illustrated in FIG. 6 may be found to be preferable.

FIGS. 7 and 8 show a further embodiment wherein the element is adapted to be received completely between adjacent studs.

In the embodiment of FIGS. 7, 8 and 9 the pointed flanges 16 extend outwardly from the lateral arms 8, in directions substantially parallel with the longitudinal axis of the body section 4 and are adapted for driving engagement into the facing sides of adjacent studs 6 as clearly shown in FIGS. 8 and 9.

This latter embodiment while still providing insulation support and rigidity to the wall structure has the advantage that all portions of the elements are positioned completely between the studding members 6 and behind the plane of the outer edge surfaces of the studs.

In use, the element of FIG. 7 is simply positioned between studs 6, and the pointed flanges 16 driven into the sides of the studs, as shown in FIG. 8, by hammer blows.

FIG. 9 which is a sectional view along line 9—9 of FIG. 8 shows one pointed flange 16 driven into the side of stud 6 and holding insulation 12 against sheeting 10.

In the embodiment shown in FIGS. 1 through 6 the lateral arms 8 are angled normally (at right angles) or substantially normal with respect to the central body section 4, whereas in the embodiment shown in FIGS. 7, 8 and 9 the lateral arms 8 are positioned at an acute angle with the body section so that the pointed flanges 16 can be received between the studding members without deformation of the element being required.

As indicated above, the use of an element according to the present invention greatly simplifies and speeds the secure positioning of insulation material during construction of homes and other buildings, thus minimizing time required for completion of the task and enabling the job to be completed at less cost. In addition to the cost and simplicity factor, the present element also results in increased rigidity of the finalized building. Much of the studding lumber used in construction to-day is of the "green" variety not having been properly dried, and it is often found that warping and spiralling of studding occurs even after the studding has been erected and the outer sheeting material applied. When such warping occurs the proper positioning of wallboard, or whatever other interior finishing layer, is extremely difficult and often renders finalization of a satisfactory inner surface quite difficult. The use of the present element, however, minimizes the occurrence of such after-erection warping, and thus not only does the present element achieve significant advances in speed and resultant economies, but also results in a more stable and true final structure.

I claim:

1. A unitary construction element adapted particularly for use in the securement of insulation batts or boards between framing or studding members, the element having a generally U-shape and comprising an elongated central body section of a length to be received between two adjacent stud members of standard spacing without deformation, the ends of the body section being angled with respect to the body section providing lateral arms of a length less than the depth of the framing members, the ends of the lateral arms being angled providing longitudinal arm sections which are substantially parallel with the longitudinal axis of the body section, and pointed flanges extending inwardly from the outer ends of the longitudinal arm sections for driving penetration into outer surfaces of the framing members.

2. An element according to claim 1, whereby the length of the lateral arms determine positioning of the body section with respect to framing depth.

3. Element according to claim 1, wherein at least a portion of the length of the body section has a curved cross-section.

4. Element according to claim 1, wherein the body section is provided with pointed prongs pointing in the same direction as the pointed flanges.

5. Element according to claim 1 wherein the length of the longitudinal arm sections is less than the width of the outer surface of the framing members.

* * * * *